US007703248B2

(12) United States Patent
Dincel

(10) Patent No.: US 7,703,248 B2
(45) Date of Patent: Apr. 27, 2010

(54) HOLLOW INTERCONNECTING PANELS AS LOST FORMWORK

(76) Inventor: Burak Dincel, Level 3, 7k Parkes St., Parramatta, New South Wales 2150 (AU)

( * ) Notice: Subject to any disclaimer, the term of this patent is extended or adjusted under 35 U.S.C. 154(b) by 46 days.

(21) Appl. No.: 10/490,343

(22) PCT Filed: Oct. 10, 2002

(86) PCT No.: PCT/AU02/01382

§ 371 (c)(1),
(2), (4) Date: Mar. 22, 2004

(87) PCT Pub. No.: WO03/031740

PCT Pub. Date: Apr. 17, 2003

(65) Prior Publication Data

US 2004/0244321 A1 Dec. 9, 2004

(30) Foreign Application Priority Data

Oct. 12, 2001 (AU) ..... PR 8240

(51) Int. Cl.
*E04B 2/86* (2006.01)

(52) U.S. Cl. ..... 52/284; 52/439; 52/282.1; 52/309.15; 52/309.17; 264/239; 264/209.1

(58) Field of Classification Search ..... 52/426, 52/429, 439, 563, 568, 581, 588.1, 561–572, 52/275, 570, 596–607, 433, 592.4–592.5, 52/592.6, 284, 282.1, 282.2, 309.15, 309.17; 264/239, 209.1
See application file for complete search history.

(56) References Cited

U.S. PATENT DOCUMENTS 3,440,785 A 4/1969 Denny et al.
3,460,304 A 8/1969 Braeuninger et al.
3,555,751 A 1/1971 Thorgusen
3,742,672 A * 7/1973 Schaeufele ..... 52/592.1
3,815,311 A 6/1974 Nisula et al.
3,828,502 A 8/1974 Carlsson
4,104,837 A * 8/1978 Naito ..... 52/579
4,236,366 A * 12/1980 Rijnders ..... 52/580
4,299,070 A * 11/1981 Oltmanns et al. ..... 52/309.11
4,438,614 A * 3/1984 Raith et al. ..... 52/580
4,884,382 A * 12/1989 Horobin ..... 52/426
4,967,528 A * 11/1990 Doran ..... 52/309.12
5,216,863 A * 6/1993 Nessa et al. ..... 52/439
5,274,975 A 1/1994 Haag
5,293,728 A 3/1994 Christopher et al.
5,404,686 A 4/1995 Esposito
5,465,545 A * 11/1995 Trousilek ..... 52/425

(Continued)

FOREIGN PATENT DOCUMENTS

EP 0 522 541 1/1993

(Continued)

*Primary Examiner*—Jeanette Chapman
(74) *Attorney, Agent, or Firm*—Ladas and Parry LLP

(57) ABSTRACT

An elongated building element (14) to form a series of walls (10) to (13). The elements (14) each have longitudinally extending flanges (21) that snap engage with longitudinally extending grooves (19) in the next adjacent element (14). Accordingly the wall (10) is constructed by joining the elements (14) in a direction transverse their general direction of extension. If so required the elements (14) may be filled with concrete.

12 Claims, 2 Drawing Sheets

U.S. PATENT DOCUMENTS

| | | | | | |
|---|---|---|---|---|---|
| 5,608,999 | A | * | 3/1997 | McNamara | 52/275 |
| 5,706,620 | A | | 1/1998 | De Zen | |
| 5,729,944 | A | * | 3/1998 | De Zen | 52/439 |
| 5,740,648 | A | * | 4/1998 | Piccone | 52/426 |
| 5,953,880 | A | | 9/1999 | De Zen | |
| 5,974,751 | A | * | 11/1999 | De Zen | 52/439 |
| 6,021,646 | A | | 2/2000 | Burley et al. | |
| 6,105,315 | A | * | 8/2000 | Stoecklein et al. | 52/134 |
| 6,167,669 | B1 | * | 1/2001 | Lanc | 52/426 |
| 6,189,269 | B1 | | 2/2001 | De Zen | |
| 6,212,845 | B1 | * | 4/2001 | De Zen | 52/607 |
| 6,247,280 | B1 | | 6/2001 | Grinshpun et al. | |
| 6,658,808 | B1 | * | 12/2003 | Doherty et al. | 52/580 |

FOREIGN PATENT DOCUMENTS

| | | | | |
|---|---|---|---|---|
| FR | 2710676 | A1 | * | 4/1995 |
| WO | 94/19552 | A1 | | 9/1994 |
| WO | 95/33106 | A1 | | 12/1995 |
| WO | 00/65167 | A1 | | 11/2000 |

* cited by examiner

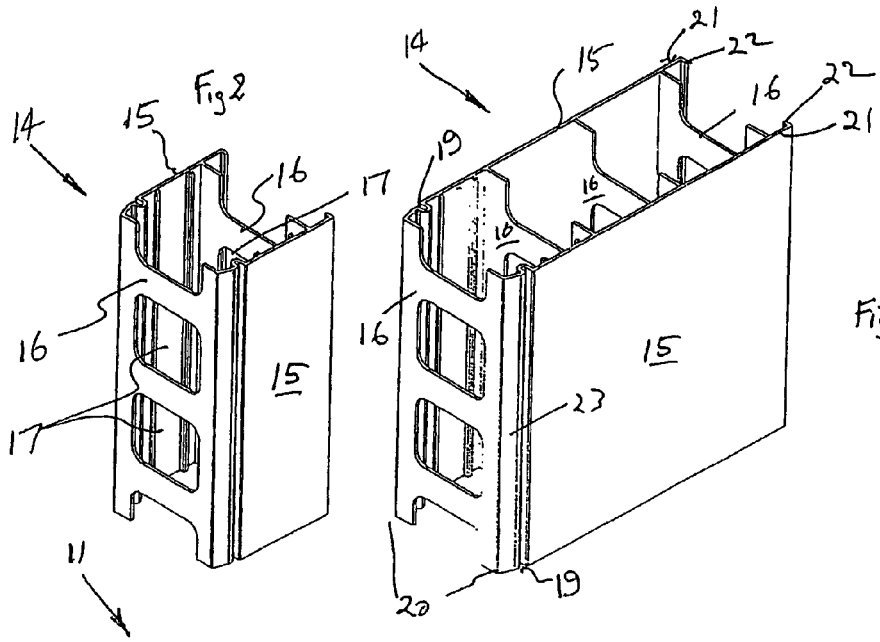
Fig 2
Fig 1
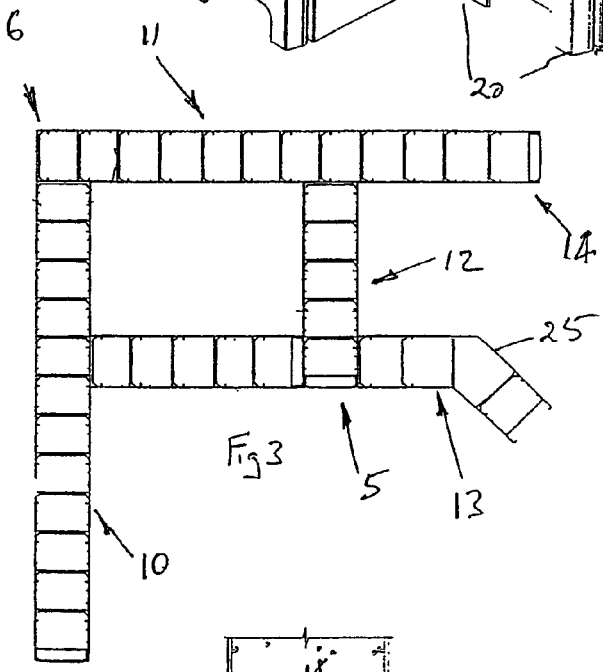
Fig 3
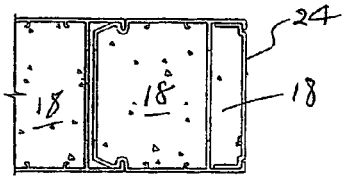
Fig 4
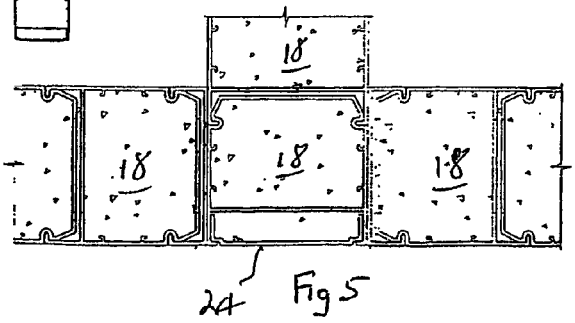
Fig 5
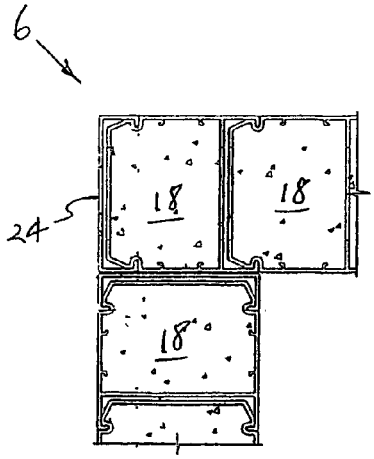
Fig 6

HOLLOW INTERCONNECTING PANELS AS LOST FORMWORK

TECHNICAL FIELD

The present invention relates to building elements and more particularly but not exclusively to building elements which are joined to form walls of a building.

BACKGROUND OF THE INVENTION

It is known to form walls from building elements which are vertically extended extruded hollow members. Adjacent members are connected by cooperating flanges and grooves with the elements joined by longitudinal sliding relative movement. The elements are hollow and are subsequently filled with concrete to provide them with strength and rigidity. Typically, the building elements are formed of extruded plastics material.

U.S. Pat. No. 6,212,845 discloses a building element typically as described above. A wall is constructed by connecting adjacent elements by first connecting one element to a floor and then coupling subsequent elements thereto by vertically sliding relative motion. A similar construction is also disclosed in U.S. Pat. Nos. 6,189,269, 5,974,751, 5,953,880, 5,729,944 and 5,706,620.

The above discussed elements have a disadvantage in that their sliding relative movement for coupling purposes hinders their assembly. Their lengths makes them difficult to handle when being placed in position to form a wall.

A further disadvantage is that each element has either two male or two female coupling portions. Thus there is the need to manufacture and stock a variety of different elements.

Less relevant structures are described in U.S. Pat. Nos. 3,440,785, 3,555,751, 3,815,311, 3,828,502, 4,104,837, 5,274,975, 5,293,728, 5,404,686 and 6,247,280.

OBJECT OF THE INVENTION

It is the object of the present invention to overcome or substantially ameliorate the above disadvantage.

SUMMARY OF THE INVENTION

There is disclosed herein a hollow elongated building element including:

a pair of longitudinally extending spaced side walls which are generally parallel and coextensive;

transverse webs joining the side walls; and wherein said element has at least one longitudinally extending groove and at least one longitudinally extending flange, with the flange and groove being positioned and configured to engage a respective groove or flange of a like element to secure the elements together by snap engagement of the flange within its respective groove by movement transverse of the element.

Preferably, the element has a pair of grooves and a pair of flanges, with each groove being formed in a respective one of the side walls, and each flange being an extension of a respective one of the side walls.

Preferably, the grooves extend transversely inwardly from their respective side walls.

BRIEF DESCRIPTION OF THE DRAWINGS

A preferred form of the present invention will now be described by way of example with reference to the accompanying drawings wherein:

FIG. 1 is a schematic perspective view of a building element;

FIG. 2 is a schematic perspective view of a further building element to be used in conjunction with the building element of FIG. 1;

FIG. 3 is a schematic top plan view of a series of building walls formed with building elements such as the building elements of FIGS. 1 and 2;

FIG. 4 is a schematic enlarged view of the portion 4 of the walls depicted in FIG. 3;

FIG. 5 is a schematic enlarged top plan view of the junction 5 of the walls of FIG. 3; and FIG. 6 is a schematic enlarged top plan view of the corner 6 of the walls of FIG. 3.

DETAILED DESCRIPTION OF THE PREFERRED EMBODIMENTS

Figure 7:
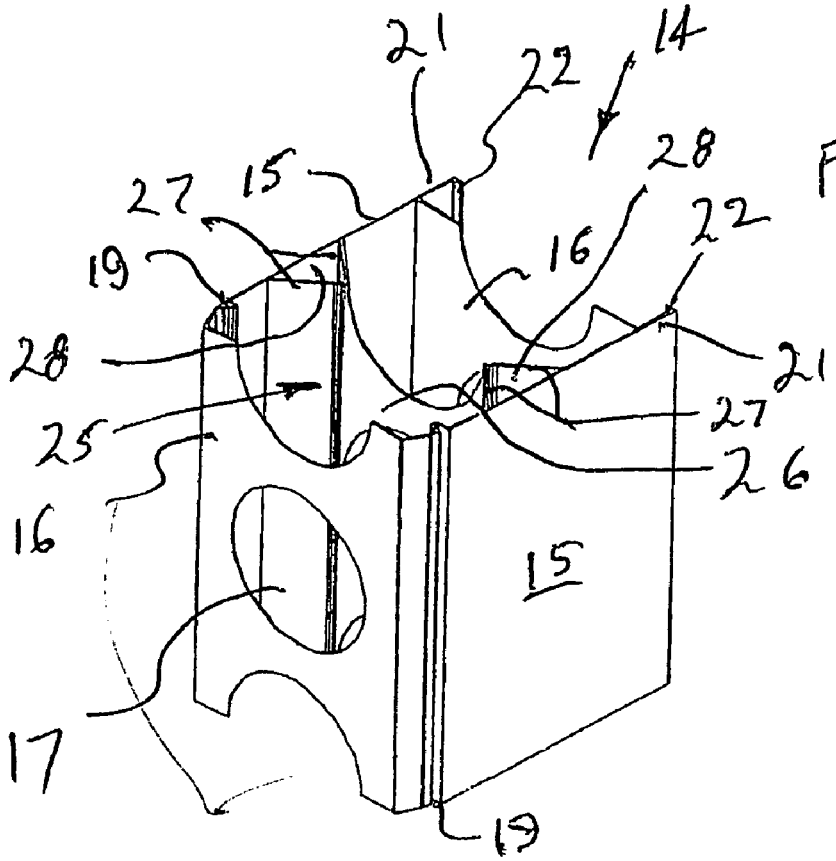
FIG. 7 is a schematic perspective view of a modification of the building element of FIG. 2.

In the accompanying drawings there is schematically depicted a series of walls 10 to 13 of a building. Each of the walls 10 to 13 is formed of a plurality of building elements 14. In this respect it should be appreciated that each of the building elements 14 is elongated, but can be of any required transverse width. For example, in FIG. 1 there is schematically depicted a modified element 14 which is wider.

The element 14 has two generally parallel coextensive side walls 15 joined by transverse webs 16. Typically, the webs 16 would have apertures 17. The elements 14 are hollow and receive concrete 18. Accordingly, the elements 14 provide a permanent formwork to receive the concrete 18. Typically, high slump concrete is poured into the assembled elements 14. Preferably, the elements 14 would be formed of extruded plastics material such as polyvinyl chloride so as to provide a permanent waterproof finish.

Each of the side walls 15 is provided with a longitudinally extending groove 19 adjacent a longitudinal edge 20 of the respective side wall 15. Extending from each side wall 15 is a longitudinally extending flange 21, the flanges 21 being generally parallel and coextensive with respect to the grooves 19. Each flange 21 includes a longitudinally extending lip 22 which is received within the grooves 19 of the next adjacent element 14. Extending to each groove 19 is a ramp surface 23.

When assembling the elements 14 adjacent elements 14 are moved in a transverse direction relative to each other, with the flanges 21 being resiliently urged apart by means of the surfaces 23. When the lips 22 are aligned with the grooves 19 they snap engage within the grooves 19 to retain adjacent elements 14 together. Accordingly, the flanges 21 extend between adjacent elements 14.

Typically, the walls 10 to 13 would be provided with end caps, such as the end caps 24. At junctions such as those illustrated in FIGS. 5 and 6, adjacent elements 14 not secured together by flanges 21 and associated grooves 19 may be secured together by other means such as adhesives and/or fasteners if so required. It should further be appreciated that the elements 14 may include bends such as the element 25 shown in FIG. 3.

When constructing the walls 10 to 13 an installer would secure guide channels to associated floor and ceiling surfaces by means of adhesives or fasteners. The elements 14 are then placed in the tracks and transversely moved into engagement. Thereafter, the elements 14 may be filled with the concrete 18.

In the case of site concrete filled elements 14, the walls 10 to 13 can be poured either with the slab above or prior to the slab formwork of the level above.

The walls 10 to 13 may be load bearing or non-load bearing as required. Still further, if so required, reinforcing elements may pass longitudinally through the elements 14.

In FIG. 7 there is schematically depicted a modification of the building elements 14. In this embodiment a transverse web 25 is provided to aid in stiffening the longitudinal side walls 15. More particularly the transverse web 25 has a central flange 26 joined to the walls 15 by means of diverging end flanges 27. The end flanges 27 diverge from the flange 26 toward the walls 15. The transverse web 25 enables the flanges of walls 15 to be decreased relative to previous similar elements.

In FIG. 7 the longitudinally extending recesses 28 can be used to duct service items such as electrical and communication cables.

Figure 8:
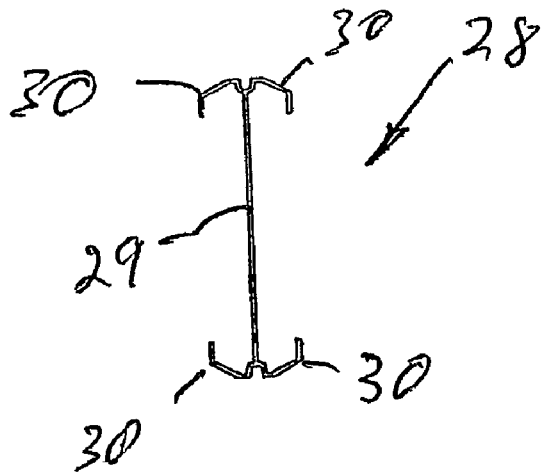
FIG. 8 is a schematic end elevation of a coupling element employed with the building elements of FIGS. 1 to 7.

In FIG. 8 there is schematically depicted a coupling member 28. The coupling member 28 enables adjacent elements to be coupled in which the adjacent elements have adjacent grooves 19 as opposed to grooves 19 and flanges 21. The member 28 has a central elongated web 29 and flanges 30 to snap engage in the grooves 19.

As can be seen from the element 14 of FIG. 7, the aperture 17 maybe of an alternative configuration such as circular.

The invention claimed is:

1. An extruded hollow longitudinally elongated building element into which concrete is to be poured, said element being extruded so as to be integrally formed and comprising:

a pair of longitudinally extending spaced side walls which are generally parallel and coextensive; and a plurality of longitudinally extending spaced transverse webs joining the side walls, the webs including a first, a second, and a third web, with at least one of the webs having at least one aperture and one of the webs being an end web, and wherein the second transverse web is located between the first web and the third web and includes a central flange joined to the side walls by means of pairs of diverging end flanges that diverge from the central flange to the side walls;

a pair of longitudinally extending grooves, each of the grooves being formed in one of the side walls;

a pair of longitudinally extending end flanges; each of the extending end flanges extending from one of the side walls; and adjacent the end web, a pair of longitudinally extending surfaces that diverge from the end web toward the grooves;

wherein the extending end flanges and grooves are positioned and configured to engage a respective groove or extending end flange of a like element, and the extending end flanges are sufficiently resiliently deformable such that, when the extending end flanges are moved in a transverse direction relative to the diverging surfaces of the like element, there is a resilient deformation of the extending end flanges to allow a snap engagement of each extending end flange within its respective groove whereby to enable the elements to be secured together by snap engagement of the extending end flanges and the grooves.

2. The element of claim 1 wherein each extending end flange is an extension of a respective one of the side walls.

3. The element of claim 1 wherein each groove extends transversely inwardly from the respective side wall.

4. The element of claim 1 wherein said second web is located between the first and third webs to aide in stiffening the side walls.

5. A building wall comprising a plurality of building elements according to claim 1 wherein the elements are secured together by the engagement of the groove of each element with the flange of the next adjacent element, and concrete filling hollows in the elements.

6. The element of claim 2, wherein said second web is located between the first and third webs to aide in stiffening the side walls.

7. The element of claim 3, wherein said second web is located between the first and third webs to aide in stiffening the side walls.

8. The wall of claim 5, wherein said elements are longitudinally vertically oriented.

9. The wall of claim 5, wherein between adjacent elements there is a cavity that does not receive concrete, with said cavity being located between the flanges of the respective element.

10. The element of claim 1, wherein said element is extruded from a plastic material.

11. A building element according to claim 1, wherein the longitudinally extending surfaces diverge from the end web at an obtuse angle toward the grooves.

12. A building element according to claim 1, wherein the longitudinally extending surfaces comprise a planar ramp surface that diverges from the end web toward the grooves.

* * * * *